US006134987A

United States Patent [19]

Kalsi

[11] Patent Number: 6,134,987

[45] Date of Patent: Oct. 24, 2000

[54] FOLD-UP PEDAL ARM

[75] Inventor: Avtar S. Kalsi, Windsor, Canada

[73] Assignee: Teleflex Incorporated, Plymouth Meeting, Pa.

[21] Appl. No.: 09/352,224

[22] Filed: Jul. 13, 1999

[51] Int. Cl.[7] ..... G05G 1/14

[52] U.S. Cl. ..... 74/560; 74/512

[58] Field of Search ..... 74/560, 512, 513, 74/594.7

[56] References Cited

U.S. PATENT DOCUMENTS

| | | | |
|---|---|---|---|
| 1,213,826 | 1/1917 | Bloom | 74/513 X |
| 2,536,466 | 1/1951 | Rippenbein | 74/594.7 |
| 3,097,542 | 7/1963 | Chayne | 74/512 X |
| 3,541,881 | 11/1970 | Pharis | 74/512 |
| 3,975,972 | 8/1976 | Muhleck | 74/560 |
| 4,431,101 | 2/1984 | Limbacher | 192/111 |
| 4,958,607 | 9/1990 | Lundberg | 123/399 |
| 5,385,068 | 1/1995 | White et al. | 74/512 |
| 5,632,184 | 5/1997 | Callicutt et al. | 74/512 |
| 5,823,064 | 10/1998 | Cicotte | 74/512 |

FOREIGN PATENT DOCUMENTS

| | | | |
|---|---|---|---|
| 5-85220 | 4/1993 | Japan | 74/512 |

*Primary Examiner*—Mary Ann Battista
*Attorney, Agent, or Firm*—Howard & Howard

[57] ABSTRACT

A pedal assembly is characterized by a shipping connection, generally shown at (18), interconnecting the pedal arm (12) and the pedal platform (16) for pivoting the platform (16) to a shipping position (as shown in FIG. 7) generally overlying the pedal arm (12) and for pivoting to and locking the platform (16) in a locked position extending generally in the same direction and as an extension of the pedal arm (12) (as shown in FIGS. 1–3) for the normal operational pivotal movement about the operational axis. A locking pin (22) includes a beveled end (36) projecting into the space between the legs of the pedal platform (16) for engaging the arm (12) and calming the locking pin (22) out of the locked position during movement of the pedal platform (16) from the shipping position to the locked position.

7 Claims, 3 Drawing Sheets

FOLD-UP PEDAL ARM

BACKGROUND OF THE INVENTION

1. Field of the Invention

The subject invention relates to a pedal assembly of the type used in an automotive vehicle for applying the brakes, disengaging the clutch and/or applying the accelerator.

2. Description of the Prior Art

Such pedal assemblies constitute sub-assemblies which are pre-assembled and shipped to the automotive assembly plant for installation. Since such sub-assemblies function as lever arms, they are long and sometimes cumbersome. The sub-assemblies can occupy substantial space during shipping.

Therefore, it is desirable to make such assemblies compact for shipping, handling and installation while retaining the requisite lever arm length.

SUMMARY OF THE INVENTION AND ADVANTAGES

The subject invention provides an improved pedal assembly comprising a pedal arm having an upper end and a lower end, a support for supporting the pedal arm adjacent the upper end for normal operational pivotal movement about an axis and adapted to be attached to a vehicle structure, and a pedal platform disposed at the lower end for pivoting the pedal arm about the axis in response to an actuation force applied thereto. The assembly is characterized by a shipping connection interconnecting the pedal arm and the pedal platform for pivoting the platform to a shipping position generally overlying the pedal arm and for pivoting to and locking the platform in a locked position extending generally in the same direction and as an extension of the pedal arm for the normal operational pivotal movement about the axis.

Accordingly, the subject invention provides a fold-up pedal assembly to occupy a shortened space during shipping and which may be installed as a compact unit and may be unfolded to an extended locked position with the requisite length of lever arm for normal operation. The invention enhances shipping and facilitates installation while retaining the requisite operational specifications.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a pedal assembly constructed in accordance with the subject invention is shown throughout the several views. The assembly includes a pedal arm 12 having an upper end and a lower end. A support 14 supports the pedal arm 12 adjacent the upper end for normal operational pivotal movement about an operational axis and adapted to be attached to a vehicle structure, as shown in FIG. 1.

A pedal platform 16 is disposed at the lower end for pivoting the pedal arm 12 about the axis in response to an actuation force applied thereto, e.g., the force applied by the foot of a vehicle operator.

Figure 1:
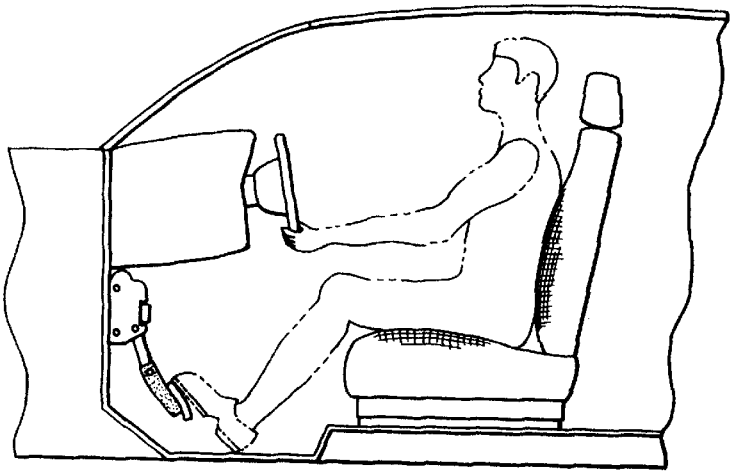
FIG. 1 is a fragmentary cross sectional view showing the subject invention in an automotive vehicle.
Figure 2:
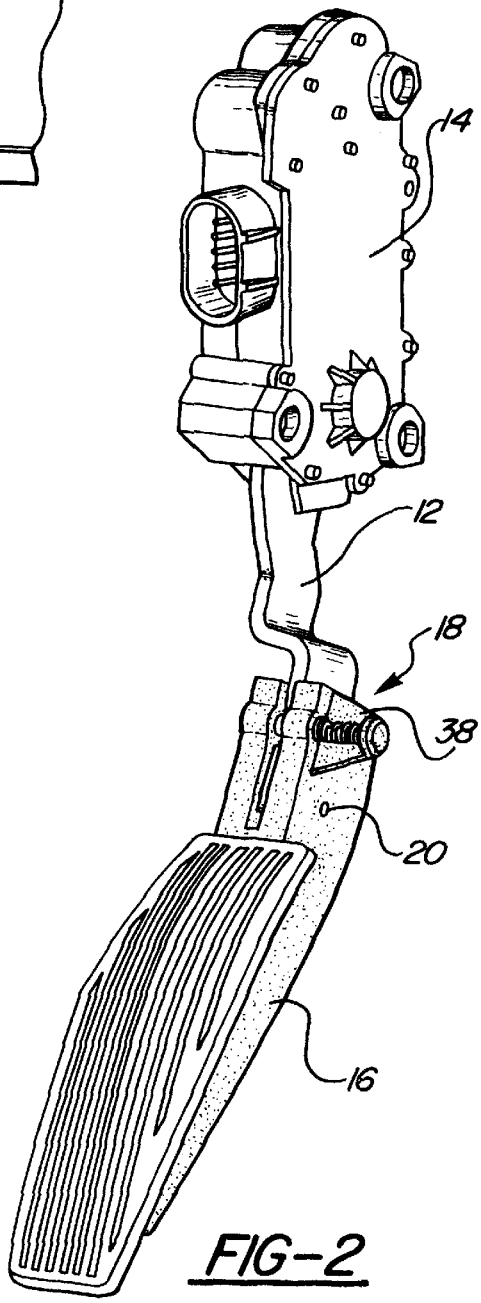
FIG. 2 is a perspective view of a preferred embodiment of the subject invention.
Figure 7:
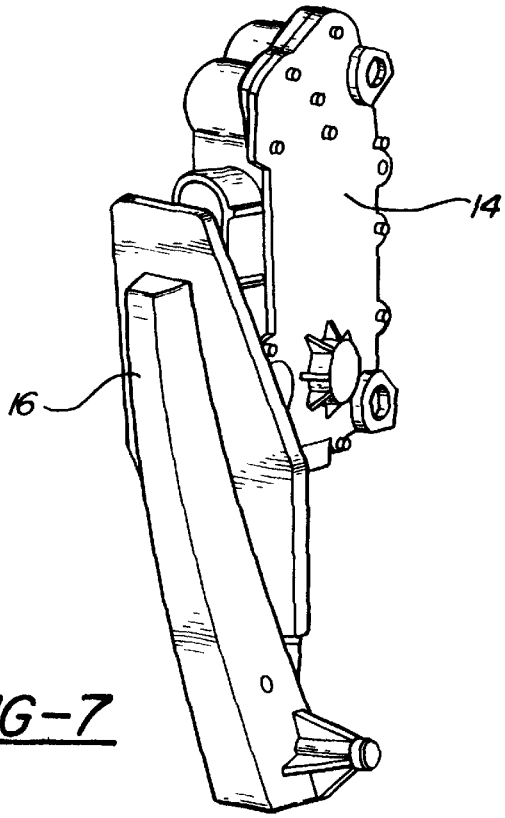
FIG. 7 is a perspective view showing the assembly in the fold-up shipping position.
Figure 3:
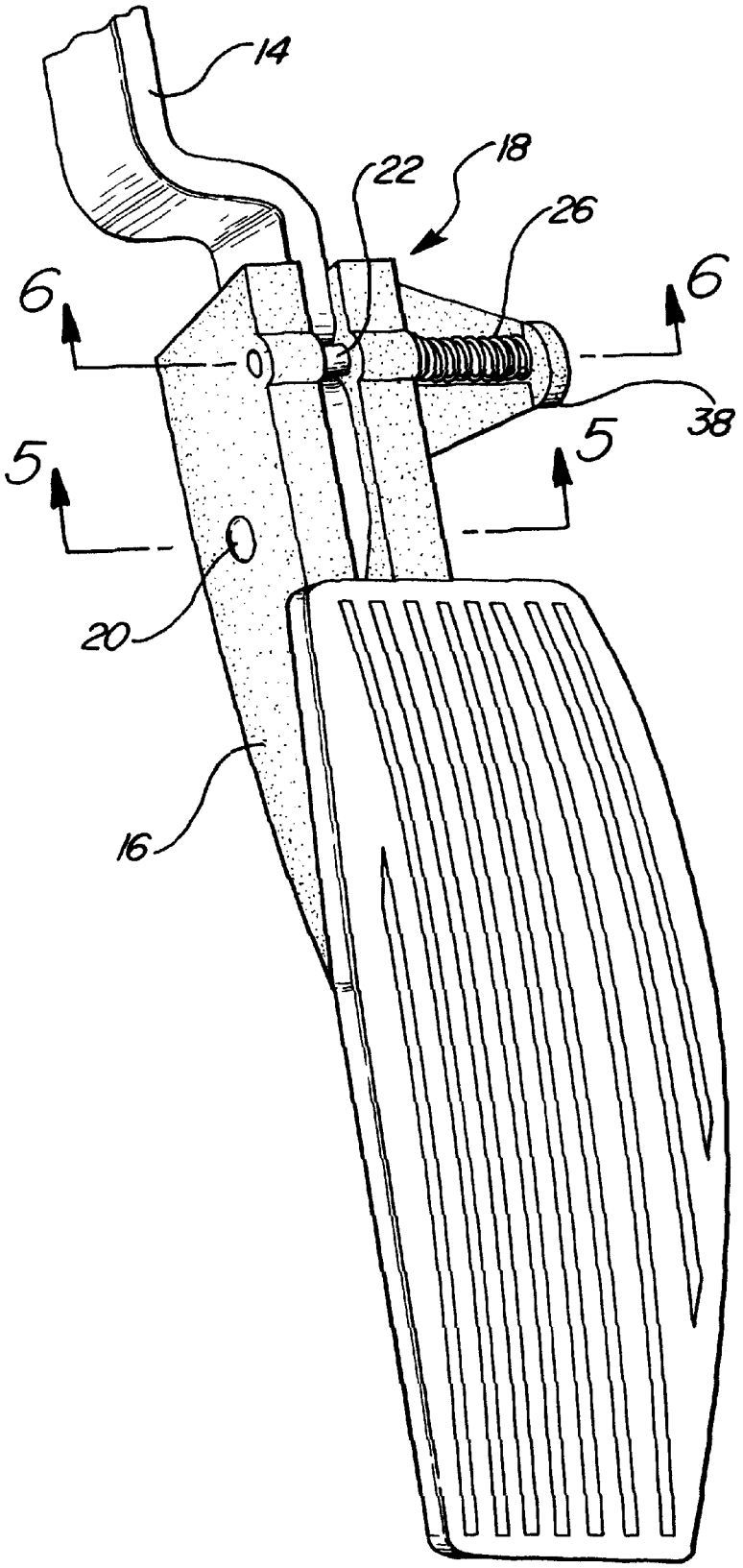
FIG. 3 is a another perspective view of the lower portion of the of the subject invention.
Figure 4:
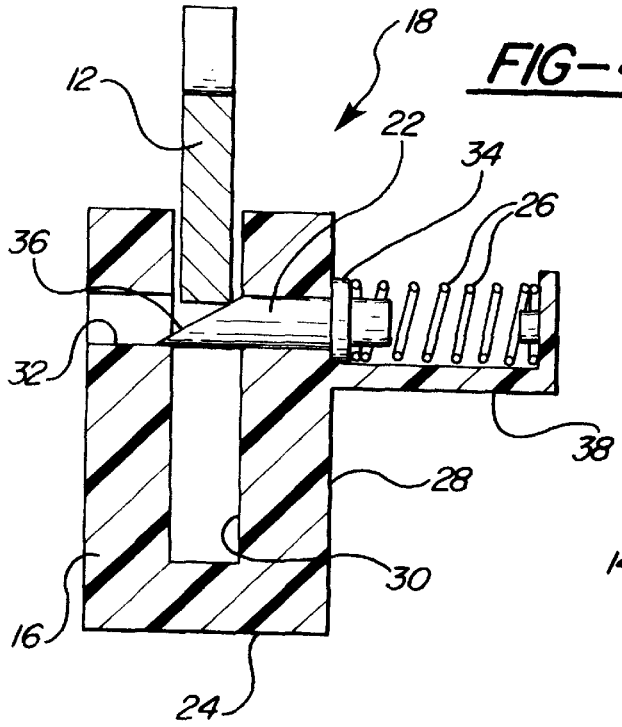
FIG. 4 is a cross sectional view showing an initial or fold-up position.
Figure 5:
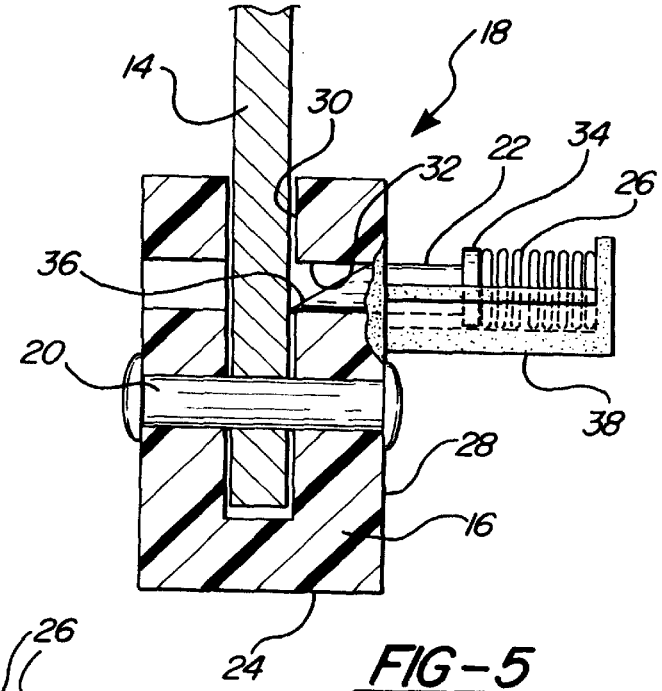
FIG. 5 is a cross sectional view taken along line 5—5 of FIG. 3.
Figure 6:
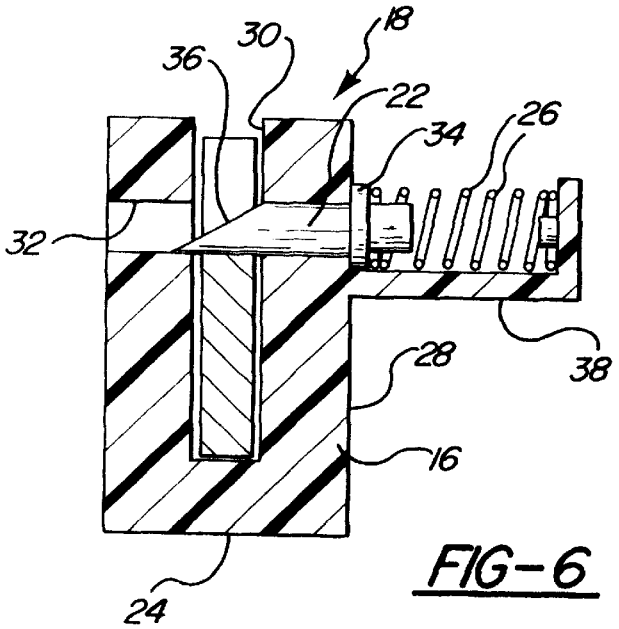
FIG. 6 is a cross sectional view taken along line 6—6 of FIG. 3.

The assembly is characterized by a shipping connection, generally shown at 18, interconnecting the pedal arm 12 and the pedal platform 16 for pivoting the platform 16 to a shipping position (as shown in FIG. 7) generally overlying the pedal arm 12 and for pivoting to and locking the platform 16 in a locked position extending generally in the same direction and as an extension of the pedal arm 12 (as shown in FIGS. 1–3) for the normal operational pivotal movement about the operational axis.

The shipping connection 18 is further characterized by including a pivot connection or pin 20 interconnecting the arm 12 and the pedal platform 16 for allowing the pedal platform 16 to pivot to and from the shipping position. The shipping connection 18 is further characterized by including a locking mechanism for locking the platform 16 in the locked position for the normal operational pivotal movement about the operational axis. The locking mechanism includes a locking pin 22 for preventing the platform 16 from pivoting about the pivot connection 20 from the locked position toward the shipping position. The pivot connection 20 and the locking pin 22 are spaced along the arm 12 from one another in the locked position. The platform 16 includes a U-shaped saddle 24 for stopping pivotal movement of the arm 12 in the locked position during pivotal movement of the platform 16 from the shipping position to the locked position. The locking pin 22 is slidably supported for longitudinal movement in and out of the locked position and a spring 26 biases the locking pin 22 to the locked position.

The U-shaped saddle 24 includes first and second legs spaced apart and interconnected by a base as viewed in cross section. The first leg has an outside surface 28 and an inside surface 30 with a hole 32 extending between the surfaces 28 and 30 and through the other leg. The locking pin 22 extends through the hole 32 and includes a head 34 for abutting the outside surface 28 in the locked position and for engaging the spring 26. The locking pin 22 includes a beveled end 36 projecting into the space between the legs for engaging the arm 12 and caming the locking pin 22 out of the locked position during movement of the pedal platform 16 from the shipping position to the locked position. The base of the U-shaped saddle 24 and the locking pin 22 are disposed on opposite sides of the arm 12. A guide 38 extends from the outside surface 28 of the first leg for supporting the spring 26 and the locking pin 22, the guide being integrally molded with the platform 16 of an organic polymeric material.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein that which is prior art is antecedent to the characterized novelty and reference numerals are merely for convenience and are not to be in any way limiting, the invention may be practiced otherwise than as specifically described.

What is claimed is:

1. A pedal assembly comprising:

a pedal arm (12) having an upper end and a lower end, a support (14) for supporting said pedal arm (12) adjacent said upper end for normal operational pivotal movement about an axis and adapted to be attached to a vehicle structure, a pedal platform (16) disposed at said lower end for pivoting said pedal arm (12) about said axis in response to an actuation force applied thereto, a pivot connection (20) interconnecting said pedal arm (12) and said pedal platform (16) for pivoting said platform (16) between a shipping position generally overlying said pedal arm (12) and a locked position extending generally in the same direction and as an extension of said pedal arm (12) for said normal operational pivotal movement about said axis and a locking mechanism spaced along said pedal arm (12) from said pivot connection (20) in said locked position for locking said platform (16) in said locked position for said normal operational pivotal movement about said axis.

2. An assembly as set forth in claim 1 wherein said locking mechanism is further characterized by including a locking pin (22) for preventing said platform (16) from pivoting about said pivot connection (20) from said locked position toward said shipping position.

3. An assembly as set forth in claim 2 wherein said locking mechanism is further characterized by said platform (16) including a U-shaped saddle (24) for stopping pivotal movement of said arm (12) in said locked position during pivotal movement of said platform from said shipping position to said locked position.

4. An assembly as set forth in claim 3 wherein said locking pin (22) is slidably supported for longitudinal movement in and out of said locked position, and including a spring (26) for biasing said locking pin (22) to said locked position.

5. An assembly as set forth in claim 4 wherein said U-shaped saddle (24) and said locking pin (22) are disposed on opposite sides of said arm (12).

6. An assembly as set forth in claim 5 wherein said U-shaped saddle (24) includes first and second legs spaced apart and interconnected by a base as viewed in cross section, said first leg having an outside surface (28) and an inside surface (30) with a hole (32) extending between said surfaces, said locking pin (22) extends through said hole (32), said locking pin (22) includes a head (34) for abutting said outside surface (28) in said locked position and for engaging said spring (26), said locking pin (22) includes a beveled end (36) projecting into the space between said legs for engaging the arm (12) and caming said locking pin (22) out of said locked position during movement of said pedal platform (16) from said shipping position to said locked position.

7. An assembly as set forth in claim 6 including a guide (38) extending from said outside surface (28) of said first leg for supporting said spring (26) and said locking pin (22).

* * * * *